US006338646B1

(12) United States Patent
Hara et al.

(10) Patent No.: US 6,338,646 B1
(45) Date of Patent: Jan. 15, 2002

(54) ZIF SOCKET ASSEMBLY HAVING A VISUAL INDICATOR

(75) Inventors: Tomohisa Hara, Nagano (JP); Yao-Chi Huang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/940,831

(22) Filed: Aug. 27, 2001

(30) Foreign Application Priority Data

Jun. 15, 2001 (TW) ..... 90210064

(51) Int. Cl.[7] ..... H01R 3/00
(52) U.S. Cl. ..... 439/488; 439/489; 439/642
(58) Field of Search ..... 439/488, 489, 439/342, 259, 266, 268, 265

(56) References Cited

U.S. PATENT DOCUMENTS 6,071,140 A * 6/2000 McHugh et al. ..... 439/342
6,231,366 B1 * 5/2001 Pei et al. ..... 439/342

FOREIGN PATENT DOCUMENTS

EP 0 335 093 A2 * 2/1989 ..... 439/488

* cited by examiner

*Primary Examiner*—Tho D. Ta
(74) *Attorney, Agent, or Firm*—Wei Te Chung

(57) ABSTRACT

A ZIF socket assembly (1) comprises a base plate (10) receiving a number of conductive contacts (30) therein, a cover (20) slidably covered onto the base plate, an actuator mechanism (40) and a visual indicator (60). The actuator mechanism is engageble with the base plate and the cover for moving the cover with respect to the base plate from an open position to a closed position. The visual indicator is pivotally disposed between the base plate and the cover and is rotatable by a movement of the cover. The visual indicator is totally embedded between the base plate and the cover in the open position and an indicating portion (63) thereof projects out of the socket assembly outline in the closed position.

12 Claims, 4 Drawing Sheets

ZIF SOCKET ASSEMBLY HAVING A VISUAL INDICATOR

BACKGROUND OF THE INVENTION

1. Field of the Invention

The present invention relates to a zero insertion force (ZIF) socket assembly, and particularly to a ZIF socket assembly having an indicator mechanism to indicate a work status thereof.

2. Description of Prior Art

Commonly, a ZIF socket assembly is adapted for supporting an electrical component, such as a Central Processing Unit (CPU), to electrically connect with a mother board. Referring to FIG. 5, a conventional ZIF socket assembly 80 comprises a rectangular base 7, a cover 8 slideably covered onto the base 7, and an actuator member 9 for driving the cover 8 moving with respect to the base 7. The base 7 defines an array of first through holes 71 for receiving conductive contacts (not shown) therein and a round opening 72 at one side thereof. The cover 8 defines an array of second through holes 81 for insertion of pins of a CPU (not shown) mounted thereon and an elliptical opening 82 corresponding to the first through holes 71 and the round opening 72 of the base 7, respectively. The actuator member 9 comprises a first cylinder 91 and a second cylinder 92 eccentrically connected with the first cylinder 91 for rotatably received in round opening 72 and the elliptic opening 82, respectively. In use, a screwdriver (not shown) is applied onto the second cylinder 92 to drive the actuator mechanism 9 rotating thereby driving the cover 8 moving with respect to base 7 from an open position where the pins are disconnected from the conductive contacts to a close position where the pins are electrically connected with the conductive contacts. However, there is no an indicator means provided onto the ZIF socket assembly 80 to indicate the ZIF socket assembly 80 is in an open position or in a close position, thereby it is difficult for one user to identify the working status of the socket assembly 80 and may damage the socket assembly 80 if t he user operates incorrectly.

Hence, an improved ZIF socket assembly is required to overcome the disadvantages of the prior art.

BRIEF SUMMARY OF THE INVENTION

A main object of the present invention is to provide a ZIF socket assembly having an indicator mechanism to indicate a work status thereof;

A minor object of the present invention is to provide a ZIF socket assembly having an indicator mechanism which is easily manufactured and assembled.

To fulfill the above mentioned objects, a ZIF socket assembly in accordance with the present invention comprises a base plate, a cover slidably covered onto the base plate, an actuator mechanism and a visual indicator. The base plate defines an array of contact holes for receiving a corresponding number of conductive contacts therein and a first pivot extending from a top face thereof. The cover defines an array of pins holes corresponding to the contact holes of the base plate for insertion of pins of a CPU mounted thereon. A second pivot projects downward from a bottom face of the cover. The actuator mechanism is engageble with the base plate and the cover for moving the cover with respect to the base plate from an open position where the pins of the CPU are disconnected from the conductive contacts to a closed position where the pins of the CPU are electrically connected with the conductive contacts. The visual indicator is pivotally disposed between the base plate and the cover and defines first and second through holes for engaging with the first and second pivots, respectively. The visual indicator is totally embedded between the base plate and the cover in the open position and is rotatable with respect to the first pivot during movement of the cover such that an indicating portion thereof projects out of the socket assembly outline to indicate the ZIF socket assembly in the closed position.

Other objects, advantages and novel features of the invention will become more apparent from the following detailed description of the present embodiment when taken in conjunction with the accompanying drawings.

DETAILED DESCRIPTION OF THE INVENTION

Figure 2:
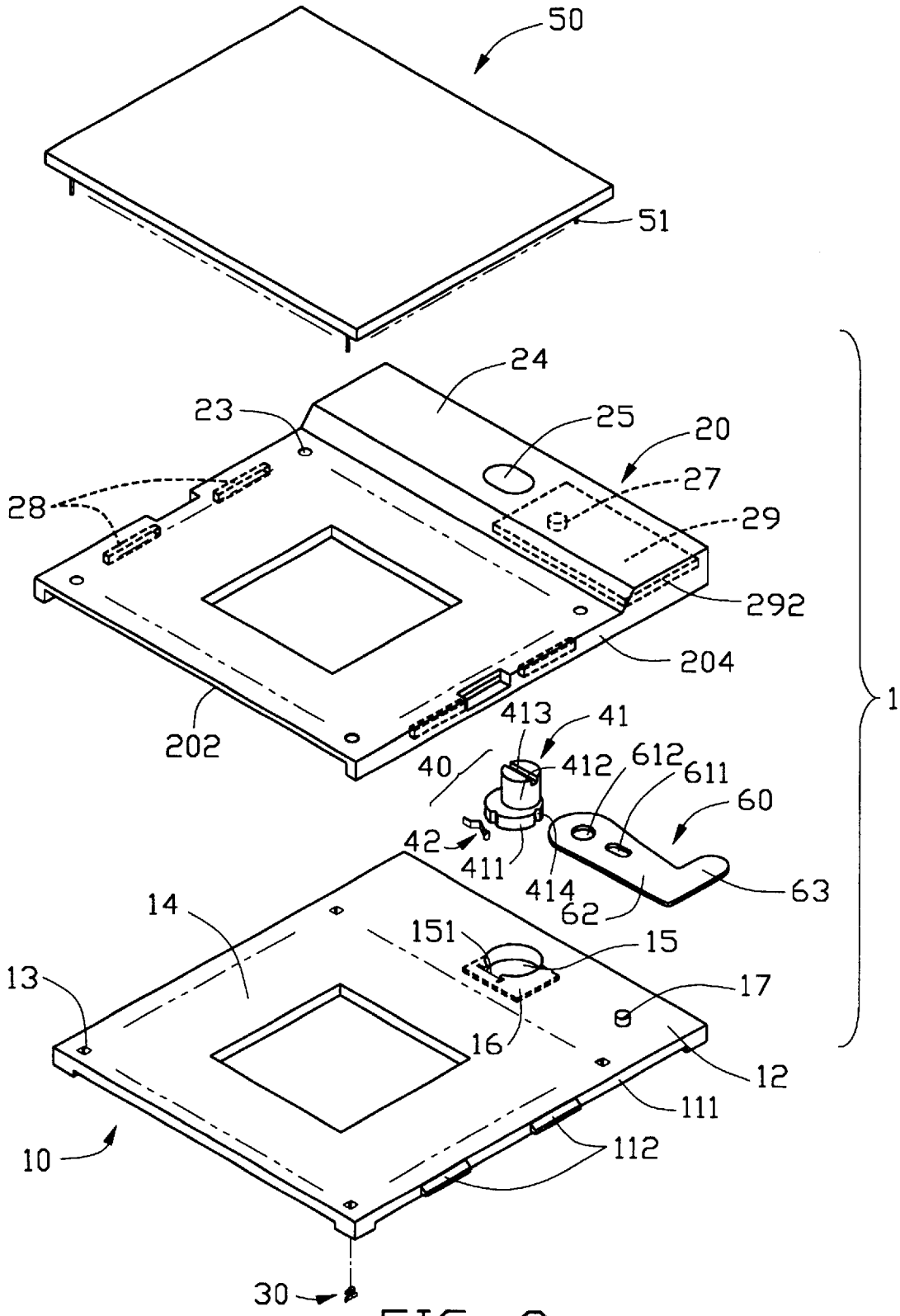
FIG. 2 is an exploded perspective view of FIG. 1.

Reference will now be made to the drawings, and first, to FIG. 2. A ZIF socket assembly 1 in accordance with the present invention comprises a base plate 10, a cover 20 slidably covered onto the base plate 10, a CPU 50 mounted onto the cover 20, an actuator mechanism 40 and a visual indicator 60.

The base plate 10, made up of plastic material or the like, defines an array of contact holes 13 for receiving corresponding conductive contacts 30 therein. The base plate 10 defines a first through hole 15 in a rear side 12 thereof and a slit 151 substantial tangent to and communicating with the first through hole 15. A standoff plate 16 extends downward from a bottom face (not labeled) of the base plate 10, communicating with and corresponding to the first through hole 15. In addition, a first pivot 17 extends upward from the top face 14 of the rear side 12 distanced from the first through hole 15. Furthermore, a pair of latches 112 are formed on either lateral side 111 of the base plate 10.

The cover 20 defines an array of pin holes 23 vertically corresponding to the contact holes 13 of the base plate 10 for insertion of corresponding pins 51 of the CPU 50 mounted thereon. The cover 20 defines at a rear side 24 thereof an elliptic hole 25 corresponding to the round hole 15 of the base plate 10 and an enlarged cutout 29 depressed in a bottom face 202 thereof receiving the visual indicator 60. A second pivot 27 extends downward from an upper face 292 of the enlarged cutout 29 and substantially has the same height as that of the first pivot 17. Additionally, a pair of recesses 28 are defined in either lateral side 204 of the cover 20 for engaging with the latches 112 of the base plate 10.

The actuator mechanism 40 comprises a driving portion 41 and a resilient tab 42 engaged with the driving portion 41. The driving portion 41 includes a first cylinder 411 and a second cylinder 412 eccentrically mounted on the first cylinder 411 for being rotatably received in the round hole 15 and the elliptic hole 25, respectively. The first cylinder 411 defines a pair of cutouts 414 spaced apart from each other along its edge. The second cylinder 412 defines a central slot 413 extending along its diameter direction for being applied by a screwdriver (not shown). The resilient tab 42 is fitted into the slit 151 of the base plate 10 and forms a tapering end (not labeled) for snapping into a corresponding cutout 414 of the driving portion 41 inserted into the round hole 15.

The visual indicator 60 is substantial in L-shaped and comprises a body portion 62 and an indicating portion 63 vertically extending from one end of the body portion 62. The body portion 62 defines a first elliptic hole 611 engaging with the first pivot 17 of the base plate 10 and a second round hole 612 aligned with the first elliptic hole 61 for insertion of the second pivots 27 of the cover 20.

Figure 1:
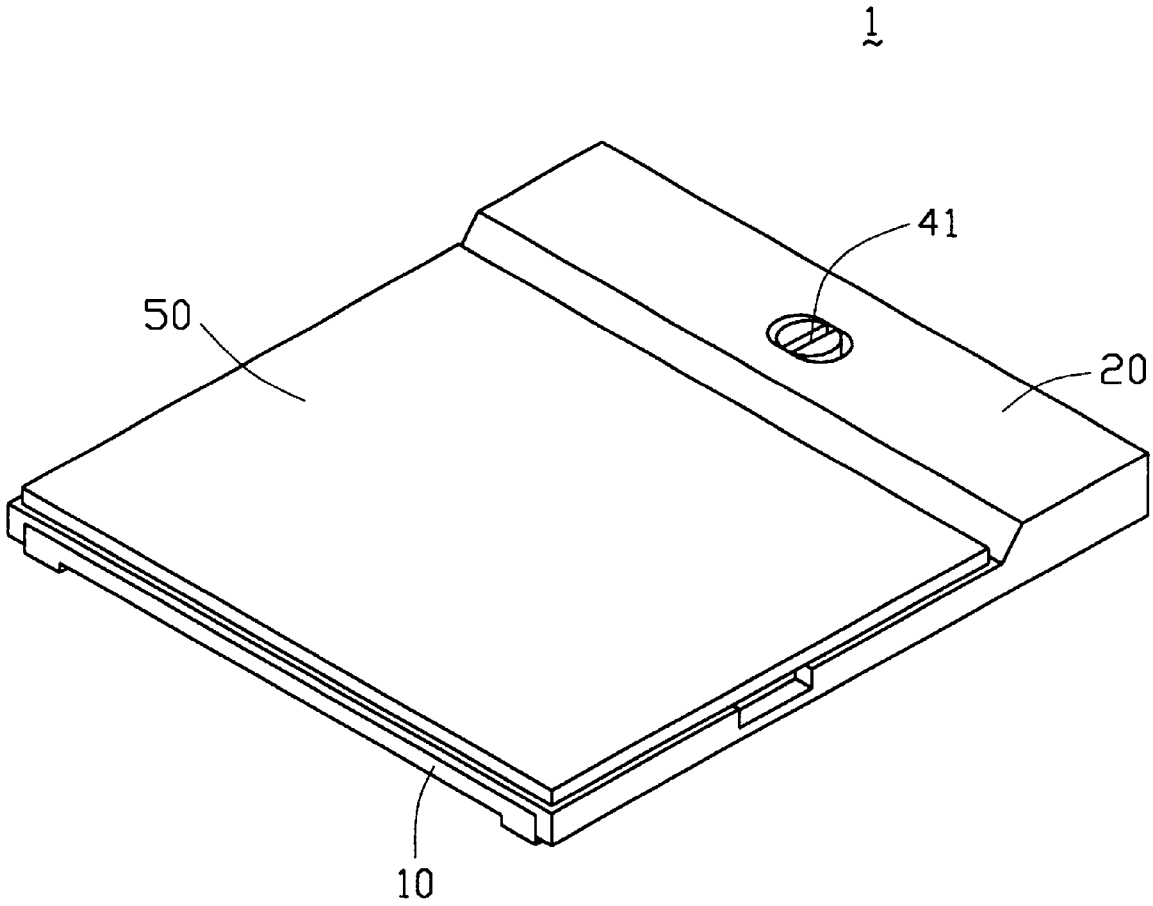
FIG. 1 is an assembled view of a ZIF socket assembly accordance with the present invention.
Figure 3:
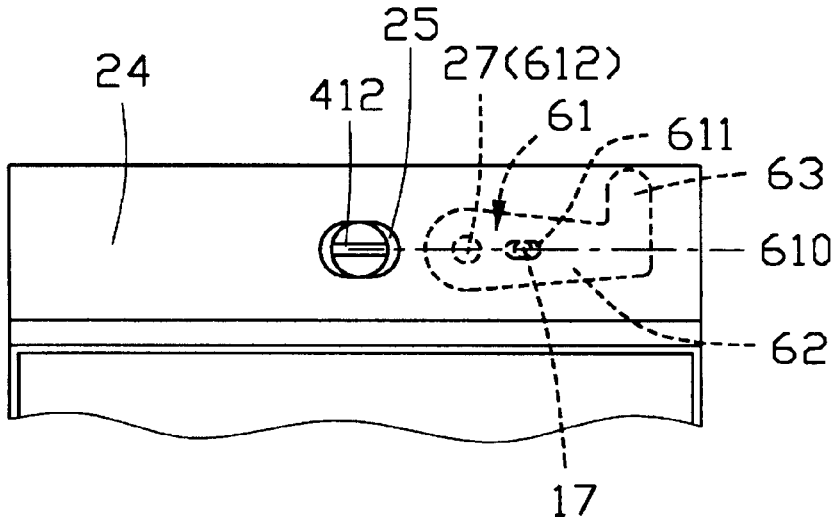
FIG. 3 is partial planar view of a ZIF socket assembly of FIG. 1 in a first status.
Figure 4:
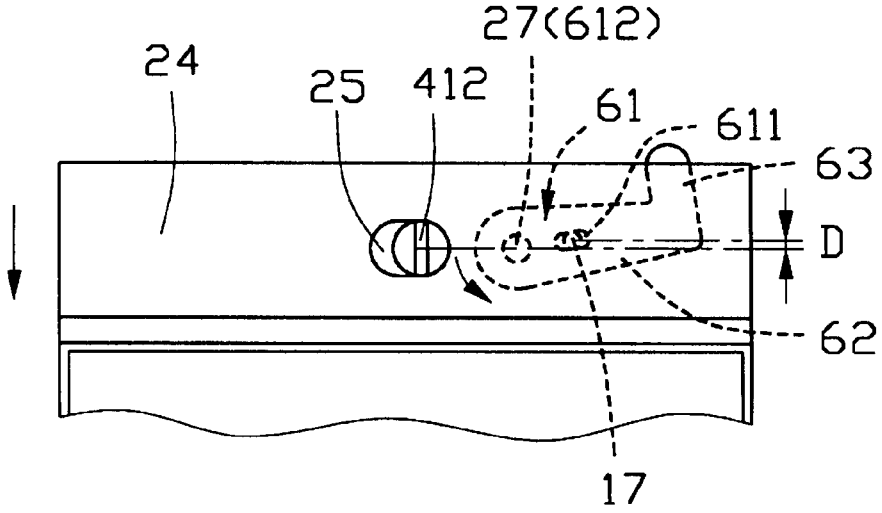
FIG. 4 is partial planar view of a ZIF socket assembly of FIG. 1 in a second status.
Figure 5:
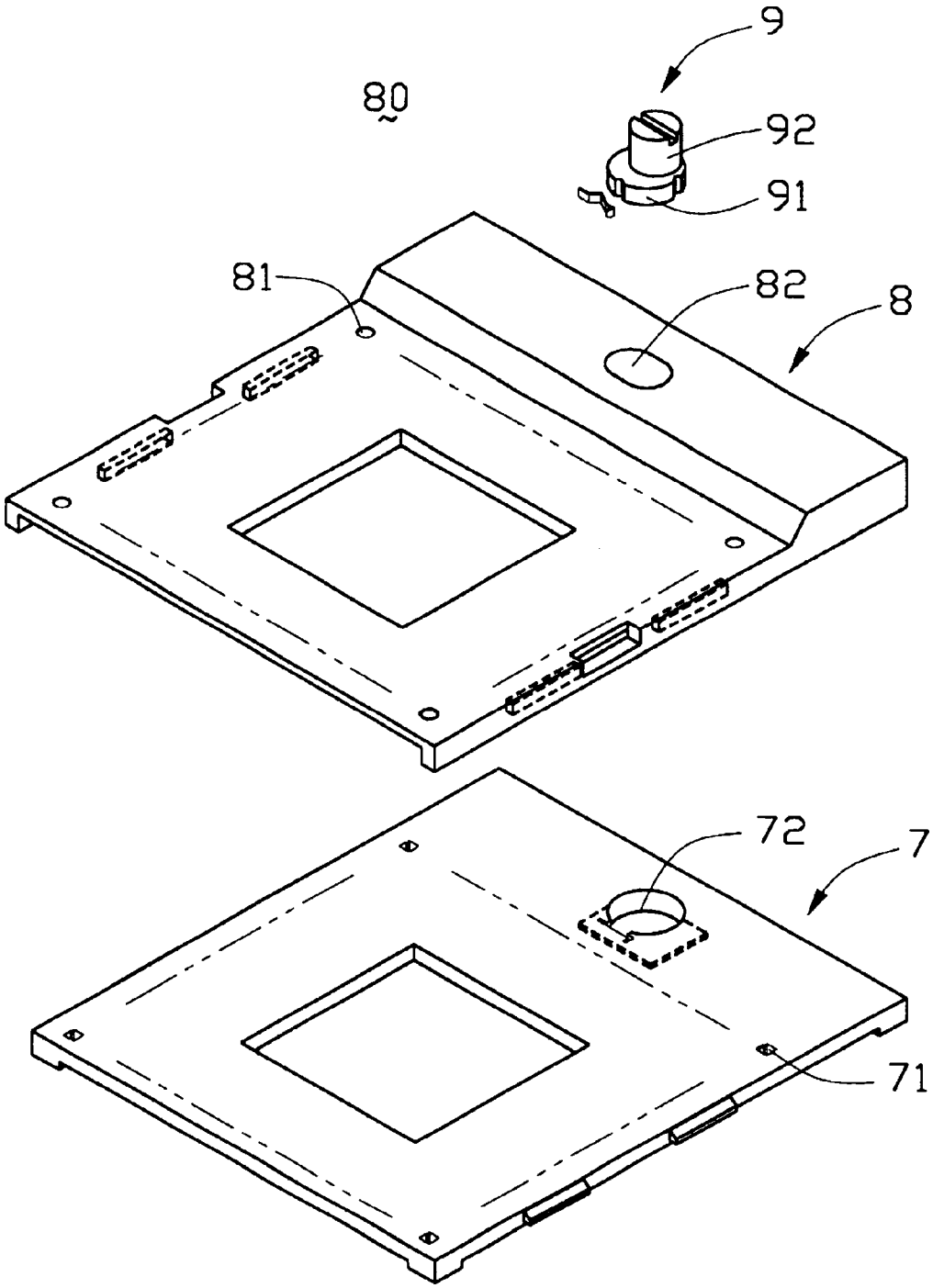
FIG. 5 (PRIOR ART)
FIG. 5 is an exploded perspective view of a conventional ZIF socket assembly.

In assembly, referring to FIGS. 1 to 4, the conductive contacts 30 are first inserted into corresponding contact holes 13 of the base plate 10. The resilient tab 42 and the first cylinder 411 of the actuator mechanism 40 are inserted into the slit 151 and the round hole 15 of the base plate 13, respectively, the resilient tab 42 being snapped into a corresponding cutout 414 of the driving portion 41. The visual indicator 60 is mounted onto the base plate 10 with the elliptic hole 611 thereof engaging with the first pivot 17 of the base plate 10. The cover 20 is then slidably covered onto the base plate 10 with the recesses 28 and the enlarged cutout 29 thereof receiving corresponding latches 112 of the base plate 10 and the visual indicator 60, respectively. Meanwhile, the elliptic hole 25 and the second pivot 27 of the cover 20 are fitted with the second cylinder 412 of the actuator mechanism 40 and the second round hole 612 of the visual indicator 60, respectively. Finally, the CPU 50 is mounted onto the cover 20 with the pins 51 thereof insertion into corresponding pin holes 23 of the cover 20, thereby getting an assembled ZIF socket assembly 1 in an open status (that is the pins 51 of the CPU 50 are disconnected from the conductive contacts 30) as shown in FIGS. 1 and 3. In this open status, the second cylinder 412 generally locates at a middle portion of the elliptic hole 25 of the cover 20, horizontal central axis lines (not labeled) of the first and second pivots 17, 27 are located on a common line 610, and the visual indicator 60 are totally covered between the base plate 10 and the cover 20. In use, the screwdriver is applied into the central slot 413 of the actuator mechanism 40 to drive the actuator mechanism 40 rotating and thus driving the cover 20 moving forward with respect to the base plate 10, thereby the second pivot 27 of the cover 20 driving the visual indicator 60 to rotate counterclockwise with respect to the first pivot 17 since the second pivot 27 of the cover 20 is fitted in the second round hole 612 of the visual indicator 60. In this way, best seen in FIG. 4, the actuator mechanism 40 is driven to rotate until the resilient tab 42 is snapped into the other cutout 414 of the driving portion 41 and the second cylinder 412 rotates to a position at one end of a long axis of the elliptic hole 25. Meanwhile, the horizontal central axis lines of the first and second pivots 17, 27 are displaced from each other with a distance (D), and the indicating portion 63 of the visual indicator 60 projects out of the outline of the socket assembly 1 from the enlarged cutout 29 of the cover 20. In this position, the socket assembly 1 attains the close status, that is, the pins 51 of the CPU 50 are mechanically and electrically connected with the conductive contacts 30. Using this arrangement, users can easily identify the ZIF socket assembly 1 is in an open position or in a closed position by seeing the visual indicator 60 being hidden in or projecting out of the outline of socket assembly 1. The disadvantage described in the prior arts is thus eliminated by the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement (e.g., pivotal/curved movement vs. linear movement, or e.g., being actuated by the cover vs. being actuated by the actuator) of parts within the principles of the invention to the full extent indicated by the broad general meaning of the terms in which the appended claims are expressed.

What is claimed is:

1. A zero insertion force (ZIF) socket assembly for supporting an electrical component to electrically connect with a mother board, the ZIF socket assembly comprising:

a base plate defining an array of contact holes and a corresponding number of conductive contacts received in the contact holes;

a cover being slidably mounted onto the base plate and defining an array of pin holes corresponding to the contact holes of the base plate for insertion of pins of the electrical component mounted thereon;

an actuator mechanism being engaged with the base plate and the cover for moving the cover with respect to the base plate from an open position where the pins of the electrical component are disconnected from the conductive contacts to a closed position where the pins of the electrical component are electrically connected with the conductive contacts; and a visual indicator being disposed between the base plate and the cover and being pivotal to be seen by a movement of the cover relative to the base plate, the visual indicator comprises a body portion and an indicating portion extending at an angle from one end of the body portion;

wherein the visual indicator is concealed between the cover and the base plate in the open position; and wherein the indicating portion of the visual indicator partially exposes outside of the cover in the closed position.

2. The ZIF socket assembly as claimed in claim 1, wherein the cover defines a recess in a bottom face thereof for accommodating of the visual indicator.

3. The ZIF socket assembly as claimed in claim 1, wherein the body portion of the visual indicator defines a first through hole and a second through hole, wherein a first pivot projects from a top face of the base plate for insertion into the first through hole, and wherein a second pivot is formed in the recess of the cover for insertion into the second through hole.

4. The ZIF socket assembly as claimed in claim 1, wherein one of the first through hole and the second through hole is elongated in shape.

5. The ZIF socket assembly as claimed in claim 1, wherein the actuator mechanism comprise a driving portion and a resilient tab fitted with the driving portion.

6. The ZIF socket assembly as claimed in claim 5, wherein the driving portion includes a first cylinder and a second cylinder eccentrically mounted onto the first cylinder, and wherein the base plate and the cover respectively define a first hole and a second hole for receiving the first cylinder and the second cylinder, respectively.

7. The ZIF socket assembly as claimed in claim 6, wherein the base plate defines a slit communicating with the first hole for receiving the resilient tab.

8. The ZIF socket assembly as claimed in claim 7, wherein the resilient tab forms a tapering end and wherein the first cylinder of the driving portion defines a cutout for receiving the tapering end of the resilient tab.

9. A ZIF socket assembly comprising:

a base plate with a plurality of contacts therein;

a cover slidably positioned upon the base plate with a plurality of through holes in alignment with the corresponding contacts;

an actuator mechanism engaged with both the base plate and the cover to move said cover relative to the base plate along a front-to-back direction;

a visual indicator not being a part of said actuator but positioned beside said actuator and adapted to be actuated to move when said actuator mechanism actuates the cover to have a user easily identify the status of cover relative to the base plate; and wherein said visual indicator is actuated by said cover.

10. The socket assembly as claimed in claim 9, wherein said visual indicator is actuated to pivotally move relative to the base plate.

11. The socket assembly as claimed in claim 9, wherein said indicator is positioned between the cover and the base plate.

12. A method of identifying a status of a ZIF socket assembly, comprising the steps of:

providing a base plate with a plurality of contacts therein;

positioning a slidable cover upon the base plate with a plurality of through holes in alignment with the corresponding contacts, respectively;

providing an actuator mechanism on both the base plate and the cover to actuate the cover to move along a front-to-back direction relative to the base plate; and providing a visual indicator on at least one of said base plate and said cover; wherein said visual indicator is directly actuated to move by said cover rather than said actuator mechanism.

* * * * *